United States Patent [19]

Soderberg

[11] Patent Number: 4,637,471

[45] Date of Patent: Jan. 20, 1987

[54] TUBING DRAIN VALVE USEFUL WITH HEAVY, SAND-BEARING OIL

[75] Inventor: Paul B. Soderberg, Houston, Tex.

[73] Assignee: Soderberg Research & Development, Inc., Houston, Tex.

[21] Appl. No.: 729,110

[22] Filed: Apr. 30, 1985

[51] Int. Cl.[4] ..... E21B 34/12

[52] U.S. Cl. ..... 166/373; 166/334; 166/237; 251/343; 251/348

[58] Field of Search ..... 166/373, 332, 334, 386, 166/382, 206, 217, 105, 105.4, 109, 237, 238, 241; 251/343, 354, 77, 348

[56] References Cited

U.S. PATENT DOCUMENTS

| | | | |
|---|---|---|---|
| 210,579 | 12/1878 | Stewart | 166/206 X |
| 2,495,642 | 1/1950 | Penick | 166/334 X |
| 4,103,739 | 8/1978 | Hall | 417/434 X |
| 4,151,880 | 5/1979 | Vann | 166/332 X |

*Primary Examiner*—George A. Suchfield
*Assistant Examiner*—David J. Bagnell
*Attorney, Agent, or Firm*—Browning, Bushman, Zamecki & Anderson

[57] ABSTRACT

The present invention is directed to an apparatus and method for providing a tubing drain valve suitable for use in a borehole. The present invention is particularly useful in connection with production strings employed in wells producing heavy, sand-bearing oils. The invention comprises a tubing drain valve operable independently of any action or condition on the interior of the pipe string. The tubing drain valve of the present invention is opened in response to the pulling of the pipe string from the borehole. A plurality of dogs carried by a sleeve biased to an initial position about a tubular member suitable for incorporation in a pipe string and including a valved passage through the side wall thereof are designed to engage the casing and temporarily prevent movement of the sleeve as the pipe string is being pulled from the borehole. Continued pulling of the string produces relative movement of the sleeve and tubular member along the longitudinal axis of the tubular member. The valve passage is opened only after relative movement through a predetermined distance. After the fluid passage has opened, the dogs at least partially retract within the opened passage to free the sleeve and permit the pulling of a "dry string," including the drain valve apparatus.

28 Claims, 6 Drawing Figures

TUBING DRAIN VALVE USEFUL WITH HEAVY, SAND-BEARING OIL

BACKGROUND OF THE INVENTION

1. Field of the Invention

The present invention generally relates to a tubing drain valve suitable for use in a borehole and a method for operating the disclosed valve. The present invention is useful in a production string where it provides a convenient apparatus and method for draining production fluid from the string in order to facilitate routine activities, e.g., removal of the downhole pump, and is particularly useful in strings used in the production of heavy, sand-bearing oils. More particularly, the present invention relates to a tubing drain valve actuated to its open position by causing a plurality of dogs carried by a sleeve disposed about the tubular member bearing the valve to engage temporarily the casing of the well bore to actuate the valve passage to the open position.

2. Description of the Background

It is often desirable to have a drain valve located in the wall of a borehole tubing string. It is particularly desirable to have a tubing drain valve located in a production string for a variety of reasons. For example, a tubing drain valve would be useful in a production string to facilitate the draining of the column of production fluid in the string prior to pulling the string or the downhole pump. A tubing drain valve would also be useful to inject chemicals into the formation or to aid in cleaning paraffin, wax and other deposits from the interior of the string.

The efficiency of production strings is often decreased by the deposit of paraffin, wax and similar substances on the interior of the string as the string rises through lower temperature zones from a deep, high-temperature production zone. It is necessary to remove these deposits in order to maintain the efficiency of the production string. Present methods for removing these deposits include flowing hot water or steam over the deposits. The hot water or steam is typically forced down the annulus between the production string and the borehole casing. The hot water or steam enters the production string through the downhole pump and returns to the surface through the string and the elevated fluid temperature slowly dissolves the deposits. Because the path to the zone of interest is long and circuitous, the cleaning fluid reaches the zone of interest at a temperature significantly lower than the injected fluid.

It is often desirable to inject the producing zone with a variety of chemicals to increase or aid production. These chemicals are injected by the previously described method for injecting steam or hot water. These methods suffer from the disadvantage that excessive quantities of fluids and chemicals are required because the injection is indirect through the annulus. Alternatively, dedicated small diameter injection tubing is employed to directly inject chemicals into the production zone.

It is often necessary to pull the production pump for routine maintenance, repair, replacement and the like. Many presently employed systems require that the production string be pulled in order to pull the production pump. This is necessary because the production pump will not pass through the interior of the production string due to size differential or obstructions in the string. Deep production strings may reach many thousands of feet or even several miles in length. The weight of these strings is quite substantial and significantly complicates the pulling of the string. Further, the weight of the fluid column within a long string adds many tons and contributes substantially to the weight complications. The equipment required to pull a "wet string," i.e., a string from which the production fluid has not been drained, must be capable of pulling this excessive and unnecessary weight. Accordingly, it is desirable to drain the fluid from the string prior to pulling the string or the downhole pump.

In an attempt to solve some of the above problems, others have proposed a variety of valves suitable for use in a borehole production string. For example, valves which open when the pressure within the tubing exceeds a predetermined pressure have been proposed. Such valves permit fluid communication between the interior of the production string and the annulus at the valve location. These valves are useful for draining the production string above the valve location and for injecting chemicals into the borehole at the valve location only if the valve remains open after its initial opening. It is typically necessary to pull the production string in order to close these valves. Alternatively, other check valves, e.g., spring loaded valves operable only above a predetermined pressure, permit injection of fluids into a borehole at the valve location but fail to provide a means for draining fluid from the production string.

Co-pending U.S. patent application Ser. No. 618,469 discloses a tubing drain valve opened when the pressure within the tubing exceeds a predetermined pressure and closed by a mechanical actuator located on the string of sucker rods for operating the downhole pump. However, that valve, like other valves actuated to the open position by application of a predetermined pressure to the fluid within the production string, typically does not perform satisfactorily when employed in strings for producing heavy, sand-bearing oils. These production strings are characterized and plagued by the precipitation and accumulation of sand and heavy paraffins in the production string. This accumulation often prevents the pressure applied to the production string from being applied to the tubing drain valve, necessitating the pulling of a "wet string."

Accordingly, there has been a long felt but unfulfilled need within the industry for a tubing drain valve which is useful in wells producing heavy, sand-bearing oils. This tubing drain valve might be conveniently and reliably actuated from the surface. This tubing drain valve might be actuated by commencement of withdrawal of the production string but must not be actuated by insertion of the string. This tubing drain valve must not be actuated by the partial withdrawal of the string during the addition and insertion of additional tubing joints during insertion of the string.

SUMMARY OF THE INVENTION

The present invention provides a new and improved drain valve and method of operating the same, particularly useful in a borehole pipe string, and more particularly useful in a pipe string employed in a deep borehole producing heavy, sand-bearing oils. This device and method provide a fluid passageway opened by pulling on the pipe string to temporarily engage a portion of the valve sub with the well casing to actuate the valve to the open position. The valve of the present invention is not actuated in response to increased pressure within the pipe string or passage of an actuating device through the pipe string. In summary, the most preferred embodiment of the present invention comprises concentrically disposed and sealingly engaged tubular members suitable for incorporation in a pipe string and having disposed thereabout a sleeve carrying a plurality of dogs thereon and biased to an initial position to permit travel of the tubular members relative to the sleeve through a predetermined distance prior to opening the passage.

A tubing drain valve in accord with the present invention comprises a valved fluid passage between the interior and the exterior of a hollow body, preferably a sub suitable for incorporation within a pipe string in a well bore and comprised of first and second cooperating, tubular sections including first and second ports for cooperation with the pipe string to permit fluid flow therethrough. Preferably the tubular members are sealingly engaged but capable of longitudinal movement relative to one another to produce the fluid communication passage through the sidewall of the sub. The tubing drain valve further includes means for temporarily preventing movement of the first section in one direction along the longitudinal axis of the device. Preferably, this means comprises a sleeve disposed about the exterior of the sub and including a plurality of dogs designed to engage the casing of the well bore to temporarily prevent movement of the sleeve toward the top of the well bore but to permit free movement of the sub toward the bottom of the well bore. Finally, in its basic embodiment, the apparatus comprises means for opening the fluid passage in response to movement of the remaining section of the apparatus in the same direction along the longitudinal axis of the apparatus after movement of the first section has been prevented.

The apparatus preferably also comprises means for disengaging the dogs to permit free movement of the entire apparatus, including the sleeve and dogs, after the passage is opened. Conveniently, the dogs partially retract within the opened fluid passage to permit free movement of the entire apparatus. In order to prevent the opening of the passage during short movement of the device toward the surface which occurs during the operation of lifting the pipe string from the slips during insertion of additional pipe joints, the apparatus further comprises means for permitting the tubular members to travel a predetermined distance after movement of the sleeve has been prevented without the passage being opened. Only after the tubular members have moved in excess of this predetermined distance relative to the sleeve will further movement of the tubular members open the fluid passage. The predetermined distance is conveniently fixed by biasing the sleeve to an initial position relative to the position at which the fluid passage will open and then overcoming the biasing means. Only after the biasing means has been overcome and the relative predetermined distance moved will further movement break a plurality of shear pins permitting the fluid passage to open.

The method of the present invention comprises temporarily preventing movement of a first section of the apparatus described above in one direction along its longitudinal axis while moving the remaining section until the fluid passage is opened. In a preferred embodiment, the remaining section is moved a predetermined distance after movement of the first section is prevented before the fluid passage is opened. Another feature of the present invention comprises releasing the first section after the passage is opened, thus permitting movement of the entirety of the apparatus. The preferred method of the present invention for operating the most preferred embodiment comprises moving the apparatus in a first direction toward the surface by pulling up on the pipe string to which the apparatus is attached. This action engages the plurality of dogs with the interior surface of the casing to temporarily prevent movement of the sleeve. Continued pulling of the string moves the tubular members relative to the temporarily fixed sleeve. Still further pulling of the string moves the tubular members through the predetermined distance and overcomes the biasing means. Finally, continued pulling of the string fractures the shear pins and opens the passage as the top tubular member continues to move and the bottom tubular member is stopped by the temporarily fixed sleeve. Because the dogs have been disposed to cooperate with the produced fluid passage, continued pulling causes the dogs to at least partially retract within the fluid passage, releasing the sleeve and bottom tubular member to travel freely with the top tubular member to the surface.

The device and method of the present invention solve the long felt but unfulfilled need for an effective tubing drain valve, reliably and easily operable from the surface and particularly useful in connection with heavy, sand-bearing oils. The device of the present invention is quickly and conveniently operable by simple pulling up on the pipe string in which it has been incorporated. This device permits the production fluid to be conveniently drained from the production string to avoid the difficulties associated with the pulling of a "wet string." These and other meritorious features and advantages of the present invention will be more fully appreciated from the following detailed description and claims.

BRIEF DESCRIPTION OF THE DRAWINGS

Other features and intended advantages of the present invention will be more readily apparent by the references to the following detailed description in connection with the accompanying drawings wherein.

While the invention will be described in connection with a presently preferred embodiment, it will be understood that it is not intended to limit the invention to this embodiment. On the contrary, it is intended to cover all alternatives, modifications and equivalents as may be included in the spirit of the invention as defined in the appended claims.

DETAILED DESCRIPTION OF THE PREFERRED EMBODIMENT

The present invention is directed to a tubing drain valve suitable for use in a borehole and to a method for operating the disclosed valve. The present invention is particularly useful when used in a pipe string in a well producing heavy, sand-bearing oils. In the presently preferred embodiment, a plurality of dogs carried by a sleeve disposed about a tubular member suitable for incorporation in the pipe string and including a valved passage through the sidewall thereof are designed to freely pass through the casing during insertion of the sub but to engage the casing to temporarily prevent movement of the sleeve during withdrawal. In this preferred embodiment, the sleeve and tubular member move relative to one another along the longitudinal axis of the tubular member a predetermined distance after the sleeve has become temporarily engaged and before the passage is opened. Finally, the dogs at least partially retract within the opened passage to free the sleeve and permit the entire apparatus to be withdrawn from the borehole.

Figure 1:
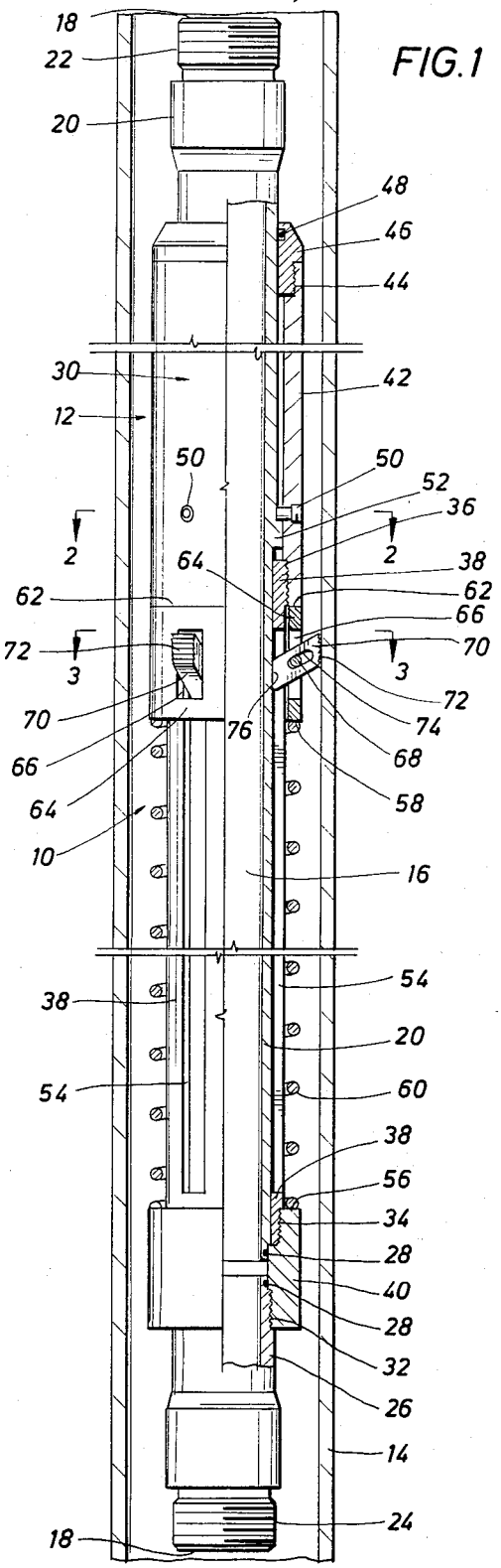
FIG. 1 is a side elevation in partial cross section of a sub including a tubing drain valve in accord with the present invention in the closed position.
Figure 2:
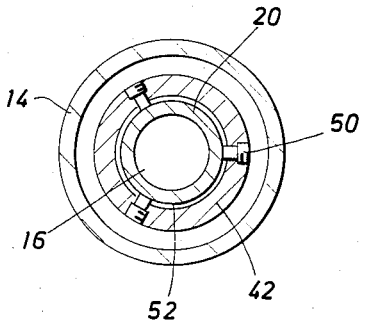
FIG. 2 is a cross-sectional illustration of a tubing drain valve in accord with the present invention through the plane 2—2 of FIG. 1.
Figure 3:
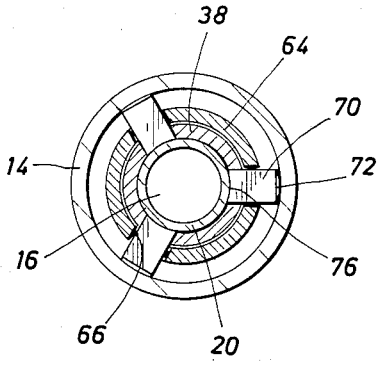
FIG. 3 is a cross-sectional illustration of a tubing drain valve in accord with the present invention through the plane 3—3 of FIG. 1.
Figure 4:
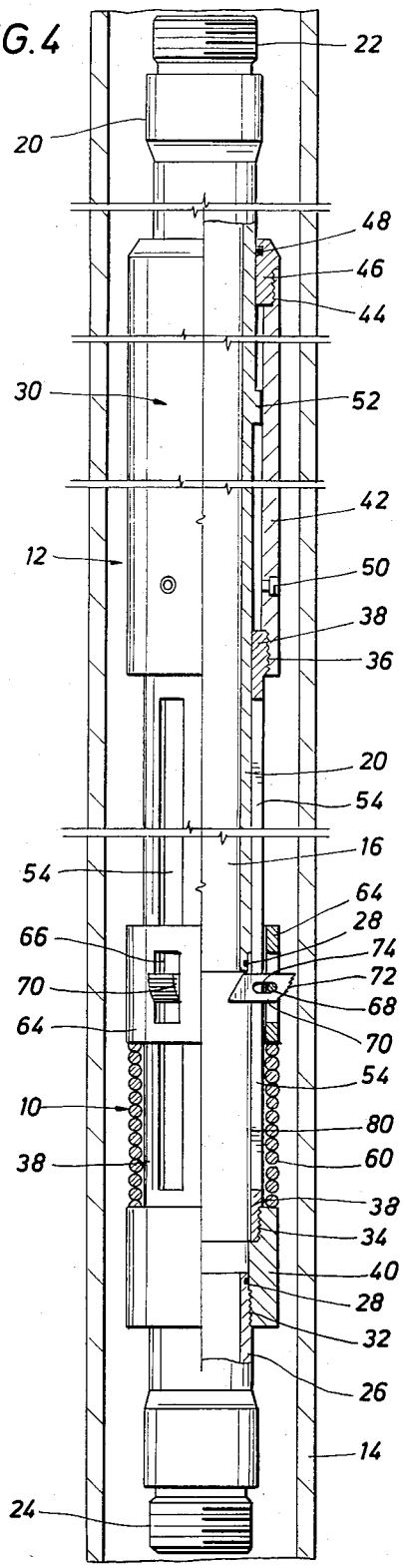
FIG. 4 is a side elevation in partial cross section of a tubing drain valve in accord with the present invention in the opened position.

A tubing drain valve 10 in accord with the present invention is ilustrated in FIG. 1 in the closed position and in FIG. 4 in the open position. The tubing drain valve 10 is illustrated in FIGS. 1 and 4 in partial cross section and disposed within a casing 14 which would typically be cemented within the borehole.

The tubing drain valve 10 is located within a sub 12 comprising a first, top tubular member 20 threaded at one end 22 for incorporation within a pipe string. The sub further comprises a second, bottom tubular assembly 30 threaded at one end 24 for incorporation within a pipe string. Tubular member 20 and tubular assembly 30 cooperate to provide a conduit 16 therethrough from top and bottom ports 18 suitable for conducting production fluid through the pipe string.

The bottom tubular assembly 30 comprises a plurality of cooperating tubular members. A bottom tubular member 26 is threaded at one end 24 for incorporation within a pipe string. A plurality of other members cooperating to form bottom tubular assembly 30 are concentric to the top tubular member 20. Threadedly attached at 32 to the bottom tubular member 26 is a sealing annulus 40. The integrity of the conduit 16 through the valve sub 12 is maintained by O-ring seals 28 between the annulus 40 and, respectively, the top tubular member 20 and the bottom tubular member 26. Threadedly attached at 34 to the other side of the annulus 40 is a tubular member 38 concentrically arranged about the tubular member 20 below an upset ring 52. The tubular member 38 may be of any desired length but is typically about four feet in length to accommodate movement of a concentric sleeve 64 during insertion of additional joints into the pipe string. The tubular member 38 is characterized by a plurality of longitudinal slots 54 therethrough. The slots 54 are preferably disposed symmetrically about the member 38 and are of sufficient length, typically over three feet, to cooperate with dogs 70 as discussed below. Threadedly engaged at 36 to the opposite end of the tubular member 38 is another tubular member 42 also concentric with the tubular member 20 but of an appropriate interior configuration or diameter to be free of interference from the upset annular ring 52 surrounding the tubular member 20. Finally, the tubular member 42 is threadedly engaged at its upper end 44 to an annulus 46 disposed about the exterior of the tubular member 20 with O-ring seals 48 and preferably configured with an angled, exterior, upper contour to facilitate extraction of the sub through the casing 14. The annulus 46 is concentric to the tubular member 20 and designed to be engaged by the upset ring 52 to prevent total separation of the top tubular member 20 and the bottom tubular assembly 30. The top tubular member 20 and the bottom tubular assembly 30 are maintained in a sealing relation by a plurality of threaded shear pins 50 extending through a plurality of cooperating bores through the side wall of tubular member 42 for cooperation with the upset ring 52 of the top tubular member 20. The shear pins 50 engage the upset ring 52 in order to prevent separation of the top tubular member 20 and the bottom tubular assembly 30, along the longitudinal axis of the sub 12.

Figure 5:
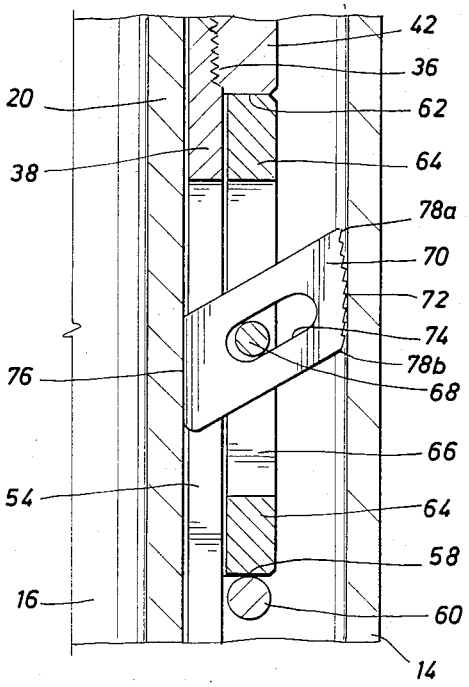
FIG. 5 is a cross-sectional illustration of a sleeve and dog in accord with the present invention engaged with a well bore casing.
Figure 6:
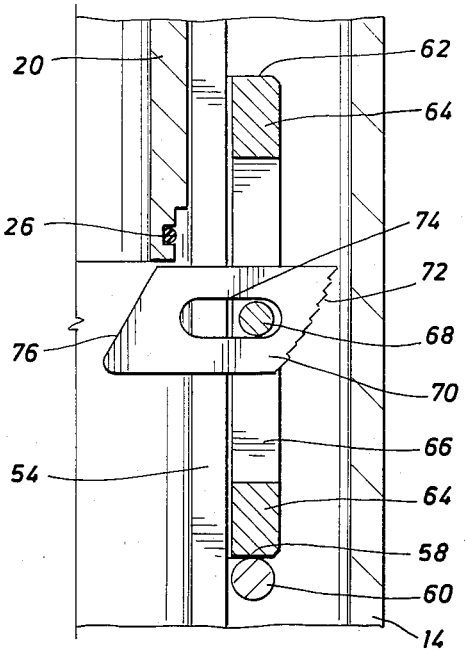
FIG. 6 is a cross-sectional illustration of a sleeve and dog in accord with the present invention partially retracted within an opened fluid passage.

The sub 12 further comprises a concentric sleeve 64 positioned about the tubular member 38. The sleeve is normally maintained in abutment with the lower end 62 of the tubular member 42 by a biasing means such as a compression spring 60 positioned between the lower end 58 of the sleeve 64 and the upper end 56 of the annulus 40. A plurality of dogs 70 are disposed about pins 68 extending circumferentially about the sleeve 64 through a plurality of symmetrically disposed holes 66 in the sleeve 64. These dogs 70 are of sufficient length and appropriate configuration to permit the sub 12 to be easily lowered into the borehole while sufficiently engaging the casing 14 to temporarily prevent movement of the dogs 70 and the sleeve 64 when the sub 12 is initially pulled from the borehole. FIG. 5 illustrates in greater detail the presently preferred embodiment. The dogs 70 each include an elongated slot 74 through which the carrying pin 68 passes. Further, each of the dogs 70 is characterized at its interior end by a smooth inner surface 76 designed to project through slots 54 in tubular member 38 to abut and slide against the exterior surface of the tubular member 20. Each of the dogs 70 includes an engaging surface, e.g., serrated engaging surface 72, on its exterior end to engage the casing 14. The engaging surface preferably includes an acute engaging point **78*a* for engaging the surface of the casing 14 to temporarily prevent movement of the dogs 70 and sleeve 64 in one direction, e.g., toward the surface. The engaging surface 72 of the dog 70 is configured, e.g., with an obtuse leading edge 78*b*, to facilitate movement within the casing 14 of the sleeve 64** in the opposite direction.

Initial pulling of a pipe string incorporating a sub 12 in accord with the present invention engages to dogs 70 with the casing 14 to temporarily prevent movement of the sleeve 64. Continued pulling of the pipe string and sub incorporating the drain valve 10 toward the surface compresses the spring 60 biasing the sleeve 64 to its initial position. The pipe string carrying the sub must be pulled through a predetermined distance before the spring 60 is fully compressed and movement of the bottom tubular assembly 30 temporarily prevented by engagement with the temporarily fixed sleeve 64. A predetermined safe distance which prevents inadvertent valve actuation during insertion of the pipe string is typically three to four feet. Typically, operators will raise the pipe string no more than one to two feet from the slips after adding each section of tubing during the insertion of the pipe string. Accordingly, the movement necessary to completely compress the spring 60 to the position illustrated in FIG. 4 should be sufficiently in excess of this typical upward movement associated with normal make-up of the pipe string. In the presently preferred embodiment, the movement required to fully compress the spring 60 is greater than three feet. Prior to the full compression of the spring 60, only the sleeve 64 and the dogs 70 are prevented from moving as the sub 12 is being withdrawn from the casing 14. However, continued pulling on the sub 12 after the spring 60 has been fully compressed shears the support pins 50 permitting the bottom tubular assembly 30 to slide along the top tubular member 20 along the longitudinal axis of the sub. This movement separates the top tubular member 20 from the bottom tubular member 26 and moves the slots 54 in member 38 into the separation, creating the fluid passage or drain 80 through the side wall of the sub. Abutment of the bottom of annulus 46 with upset ring 52 prevents further separation. Accordingly, the maximum separation movement is defined by the initial distance between the upset ring 52 and the bottom of the annulus 46. The separation disengages the top O-ring seal 28 to open a plurality of fluid passages or drains 80 from the central conduit 16 to the exterior of the sub through the plurality of longitudinal slots 54 cut in the tubular member 38.

Further, because the inward surface 76 of the dogs 70 abutted the exterior surface of the tubular member 20 which has now been removed, the dogs 70 will at least partially fall or retract through the slots 54 within the passages 80, freeing the dogs 70 and sleeve 64 from engagement with the casing 14 and permitting the entire sub to be withdrawn from the borehole. The passage provided through the slots 54 and the tubular member 38 from the interior to the exterior of the sub 12 permits the drainage of borehole fluids, including sand and any other precipitants which may be contained within the pipe string, in order to permit the pulling of a dry string.

The apparatus and method of the present invention produce the desired tubing drain passage without relying upon any action in the interior of the pipe string, e.g., an increase in the fluid pressure or an actuating device passed through the pipe string. Accordingly, the apparatus and method of the present invention is not affected by conditions on the interior of the pipe string, e.g., the precipitation of sand and the like, and is particularly useful in heavy, sand-bearing oils.

The foregoing description of the invention has been directed in primary part to a particular preferred embodiment and method in accordance with the requirements of the patent statutes and for purposes of explanation and illustration. It will be apparent, however, to those skilled in the art that many modifications and changes in the specifically described apparatus and method may be made without departing from the scope and spirit of the invention. For example, Applicant has illustrated and described a device and method employing a compression spring as the biasing means to maintain the sleeve in an initial fixed relation to the other members of the sub. Applicant believes the disclosed apparatus and method are the most convenient and economical. However, those skilled in the art will appreciate that other biasing means, including the use of an expansion spring affixed between the sleeve 64 and the tubular member 42 would also perform the same function. Therefore, the invention is not restricted to the particular form of construction and method illustrated and described, but covers all modifications which may fall within the scope of the following claims.

It is Applicant's intention in the following claims to cover such modifications and variations as fall within the true spirit and scope of the invention.

What is claimed is:

1. A sub suitable for incorporation in a pipe string in a cased well bore for conducting fluid through said sub along the longitudinal axis of said sub and including means for producing a fluid communication passageway through the sidewall of said sub, comprising:

top and bottom tubular members adapted for incorporation in a pipe string, said tubular members sealingly engaged but capable of longitudinal movement relative to one another to produce a fluid communication passage through the sidewall of said sub;

a sleeve disposed about the exterior of said sub and including a plurality of dogs, said dogs designed to permit free movement of said sub toward the bottom of a well bore but said dogs designed to temporarily prevent movement of said sleeve toward the top of said well bore by said dogs engaging the interior wall of the casing of said well bore; and means for opening said fluid communication passage by engaging said bottom tubular member with said sleeve to temporarily prevent movement of said bottom tubular member while said top tubular member is free to move toward the top of said well bore.

2. The sub of claim 1 further comprising means for disengaging said dogs to permit free movement of said sleeve and said bottom tubular member after said passage is opened.

3. The sub of claim 2 wherein said dogs are partially retractable within said opened passage to disengage and to permit free movement of said sleeve and said bottom tubular member.

4. The sub of claim 1 further comprising means for permitting said bottom tubular member to travel a predetermined distance after said dogs have become engaged and before said passage is opened.

5. The sub of claim 4 further comprising means for maintaining said sleeve in a fixed relation to said tubular members when said dogs are not engaged.

6. The sub of claim 5 wherein said means for permitting and said means for maintaining comprises biasing means.

7. The sub of claim 1 wherein said top and bottom tubular members are concentrically disposed and further comprising a shear pin disposed to restrict relative longitudinal movement of said members, said passage not openable until said shear pin is broken.

8. An apparatus suitable for conducting fluid through a conduit therein from a first to a second port and including means for producing a fluid passage through a wall of said apparatus to communicate said conduit with the exterior of said apparatus intermediate said ports, comprising:

a hollow body having a first section including said first port and a second section including said second port;

a valved fluid passage between the interior and the exterior of said hollow body through a wall of said hollow body intermediate said first and second ports;

means for engaging a surface of an object exterior of said hollow body for temporarily preventing movement of said first section in one direction along the longitudinal axis of said hollow body, said engaging means extending outwardly from said hollow body and being at least partially retractable within said fluid passage in its opened position so that said engaging means is disengaged from said surface and movement of said apparatus is permitted after said fluid passage is in its opened position; and means for opening said valved passage in response to movement of said second section in said direction along the longitudinal axis of said hollow body while movement of said first section is prevented.

9. The apparatus of claim 8 wherein said means for engaging is at least partially retractable in response to continued movement of said second section in said direction.

10. The apparatus of claim 9 wherein said means for engaging comprises a sleeve disposed about said hollow body and including dogs capable of engaging a surface exterior of said apparatus to temporarily prevent movement of said sleeve and said first section of said hollow body, said dogs being at least partially retractable within said opened passage.

11. The apparatus of claim 10 wherein said passage is not openable until said hollow body moves in said direction a predetermined distance after movement of said sleeve is prevented.

12. The apparatus of claim 11 wherein said passage is openable in response to movement of said second section in said direction in excess of said predetermined distance.

13. The apparatus of claim 8 wherein said means for opening does not function in response to movement of said hollow body in the opposite direction along the longitudinal axis of said hollow body.

14. The apparatus of claim 13 wherein said one direction is toward said second port and said opposite direction is toward said first port.

15. The apparatus of claim 8 wherein said valved passage is opened by increasing the separation of said first and second ports.

16. The apparatus of claim 8 wherein first said valved passage is opened and then said first section is disengaged by increasing the separation of said first and second ports.

17. A method for opening an initially closed fluid communication passage through the sidewall of a device between the exterior of said device and a conduit suitable for conducting fluid from a first to a second end of said device, said device having first and second longitudinally movable sections, comprising the steps of:

extending engaging means outwardly from said device for temporarily preventing movement in one direction of said first section along the longitudinal axis of said device by engaging a surface of an object exterior of said device;

moving in said direction said second section of said device along said longitudinal axis until said passage is opened; and retracting said engaging means at least partially into said opened passage to permit movement of said device.

18. The method of claim 17 comprising opening said passage by increasing the separation of said first and second ends along said axis.

19. The method of claim 17 comprising retracting said engaging means and releasing said first section by continuing movement of said device in said direction.

20. The method of claim 17 comprising moving said second section a predetermined distance in said direction while preventing movement of said first section before said passage is opened.

21. The method of Claim 20 comprising opening said passage by moving at least a part of said second section in said direction in excess of said predetermined distance.

22. A method for opening an initially closed fluid communication passage through the sidewall of a sub suitable for incorporation in a pipe string in a cased well bore, comprising:

engaging the interior wall of the casing of said well bore with a plurality of dogs extending from a sleeve disposed about a tubular body suitable for incorporation in a pipe string to temporarily prevent movement of said sleeve;

moving said tubular body relative to said temporarily fixed sleeve a predetermined distance along the longitudinal axis of said body without opening said passage;

opening said passage only after said tubular body has been moved said predetermined distance; and disengaging said dogs to permit movement of said sleeve and said tubular body.

23. The method of claim 22 comprising opening said passage by moving at least a part of said tubular body in excess of said predetermined distance along said longitudinal axis.

24. The method of claim 23 further comprising overcoming a biasing means normally maintaining said sleeve in a fixed relation to said tubular body to permit said relative movement.

25. The method of claim 24 wherein each of said steps is the result of pulling at least a part of said tubular body toward the surface of said well bore into which said device has been disposed.

26. A sub suitable for incorporation in a pipe string disposed in a well bore casing for conducting fluid through said sub along the longitudinal axis of said sub and including means for producing a fluid communication passageway through the side wall of said sub, comprising:

top and bottom tubular members adapted for incorporation in a pipe string, said tubular members longitudinally movable relative to one another;

a valved fluid passage between the interior and the exterior of the side wall of said sub, said passage openable by relative longitudinal movement of said top and bottom tubular members;

means for engaging said casing exterior of said tubular members for temporarily preventing movement of said bottom tubular member along the longitudinal axis of said casing, said engaging means extending outwardly from said tubular members and being at least partially retractable within said fluid passage in its opened position to that movement of said sub is permitted after said fluid passage is in its opened position; and means for opening said valved fluid passage in response to movement of said top tubular member relative to said bottom tubular member.

27. The sub of claim 26 wherein said means for engaging comprises a sleeve disposed exteriorly about one of said tubular members and including dogs capable of engaging said casing to temporarily prevent movement of said sleeve and said bottom tubular member, said dogs being at least partially retractable within said opened passage.

28. The sub of claim 27 further comprising means biasing said sleeve to a first position, said valved passage openable only after said biasing means has been at least partially overcome permitting movement of said sleeve a predetermined distance relative to said tubular members.

* * * * *